US006578529B2

(12) United States Patent
Hytönen et al.

(10) Patent No.: US 6,578,529 B2
(45) Date of Patent: Jun. 17, 2003

(54) ARRANGEMENT FOR FEEDING BLACK LIQUOR INTO A RECOVERY BOILER

(75) Inventors: Antti Hytönen, Äänekoski (FI); Pentti Piilonen, Äänekoski (FI); Esa Vakkilainen, Helsinki (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 09/978,175

(22) Filed: Oct. 17, 2001

(65) Prior Publication Data

US 2002/0043221 A1 Apr. 18, 2002

(30) Foreign Application Priority Data

Oct. 17, 2000 (FI) ..... 20002285

(51) Int. Cl.[7] ..... F28H 1/40

(52) U.S. Cl. ..... 122/7 R; 122/235.12; 165/179; 162/30.1; 162/30.11

(58) Field of Search ..... 122/4 D, 7 R, 122/1 B, 428, 431, 451 R, 511, 367.3, 408.1, 235.12, 235.14; 110/238, 245, 322; 165/157, 177, 179, 182; 162/30.1, 30.11, 31

(56) References Cited

U.S. PATENT DOCUMENTS

| | | | | |
|---|---|---|---|---|
| 3,574,500 A | | 4/1971 | Huouvilainen | |
| 4,248,179 A | * | 2/1981 | Bonner | 122/367.3 |
| 4,660,630 A | * | 4/1987 | Cunningham et al. | 165/179 |
| 4,880,054 A | * | 11/1989 | Yoshida et al. | 165/179 |
| 5,052,476 A | * | 10/1991 | Sukumoda et al. | 165/179 |
| 5,070,937 A | * | 12/1991 | Mougin et al. | 165/179 |
| 5,275,234 A | * | 1/1994 | Booth | 165/179 |
| 5,716,496 A | * | 2/1998 | Agren | 162/30.1 |
| 5,762,005 A | * | 6/1998 | Parisi et al. | 110/238 |
| 6,047,649 A | * | 4/2000 | Kuukkanen et al. | 110/238 |

FOREIGN PATENT DOCUMENTS

| | | |
|---|---|---|
| CA | 1127100 | 7/1982 |
| CH | 651 373 | 9/1985 |
| FI | 43945 | 3/1971 |
| FI | 67416 | 11/1984 |
| SE | 503433 | 9/1994 |
| WO | WO 96/09497 | 3/1996 |

* cited by examiner

*Primary Examiner*—Gregory Wilson
(74) *Attorney, Agent, or Firm*—Nixon & Vanderhye P.C.

(57) ABSTRACT

The present invention relates to an arrangement for introducing black liquor into a furnace of a recovery boiler, said arrangement comprising an elongated tube having an interior surface and an exterior surface, through which tube the black liquor being fed into the furnace is supplied, whereby the black liquor is taken into contact with said interior surface prior to being sprayed into the furnace. The interior surface of said elongated tube is provided with heat transfer elements and surfaces, such as fins or grooves. The heat transfer element or surface increases the heat conductivity between the tube and the black liquor above the conductivity achieved with a normal tube passage.

21 Claims, 4 Drawing Sheets

ARRANGEMENT FOR FEEDING BLACK LIQUOR INTO A RECOVERY BOILER

FIELD OF THE INVENTION

The present invention relates to an arrangement for introducing black liquor into a furnace of a recovery boiler, said arrangement comprising an elongated tube having an interior surface and an exterior surface, via which tube the black liquor is fed into the furnace, whereby the black liquor gets into contact with said interior surface before being sprayed into the furnace.

BACKGROUND OF THE INVENTION

Chemical pulp is produced by allowing wood chips react in liquor that contains cooking chemicals. Lignin and other organic compounds dissolve from the wood material into the cooking liquor during the cook. Chemical pulp and waste liquor are obtained from the cook. After the cook, the pulp is separated from waste liquor in a wash, whereby weak waste liquor having a dry solids content of 15–18 weight per cent is formed. The black liquor is further treated in a recovery boiler, wherein the organic material in the liquor is combusted to generate steam and the cooking chemicals contained in the liquor are recovered in form of smelt. Prior to combustion, the weak black liquor is concentrated in a multistage evaporation plant typically to a dry solids content of about 70–85 weight per cent.

The concentrated black liquor, so-called strong black liquor, flows from the evaporation plant into a mix tank, wherein fly ash separated from the flue gases of the recovery boiler and possible make-up chemical ($Na_2SO_4$) are added to it. From the salt cake mix tank the strong black liquor is pumped to pre-heaters and further via piping to liquor spray guns, via which the black liquor is supplied to the furnace of the recovery boiler. The liquor spray guns are used to generate small droplets for maintaining stable combustion in the furnace. Depending on the size of the boiler, and on the manufacturer, the number of liquor spray guns in the walls of the boiler varies from one to more than ten.

In principle, a liquor spray gun is a metal tube connected to a piping, where-through strong black liquor is supplied from the pre-heaters to the boiler. The end of the liquor spray gun facing the furnace is provided with a nozzle, through which the black liquor is sprayed into the furnace. The design of the nozzle varies depending on the size of the boiler and also on the manufacturer. The primary duty in the spraying is to effect it as symmetrically as possible and to ensure a proper size of the droplets.

The liquor spray gun is mounted in a wall or in a corner of the furnace of the boiler, where the spray gun is heated by heat radiation from the surrounding gases. From the spray gun tube the heat is conducted to colder black liquor flowing through the spray gun. The temperature of the liquor spray gun depends on the magnitude of outside flux and the efficiency of interior heat transfer.

One of the greatest disadvantages of prior art liquor spray guns is their limited lifetime. A liquor spray gun may serve from a couple of days to one month, after which is has to be replaced by a new one. The limited lifetime of liquor spray guns results from highly corrosive conditions and high temperature in the furnace and its surroundings, which conditions are harsh to the wall of the metal tube of the spray gun. The corrosion rate in a liquor spray gun may be from 5 to 50 mm per year.

The object of the present invention is to eliminate said problems. More specifically, the object of the present invention is to provide a liquor spray gun construction having higher durability and longer lifetime than prior art constructions.

SUMMARY OF THE INVENTION

To achieve these objects, a characteristic feature of the present invention is that the interior surface of the elongated tube is provided with rigidly attached heat transfer elements for increasing the contact surface between the interior surface of the tube and black liquor and for improving heat transfer.

The starting point for the present invention is a conventional liquor spray gun mainly comprising an elongated, possibly bent, tube having an essentially smooth and plane surface as known. As is known, the area of the interior surface of this kind of tube is $2\pi \cdot r \cdot 1$, wherein r is the interior radius of the tube and 1 is the length.

In the arrangement according to the present invention, the temperature of the metal in the liquor spray gun can be decreased by increasing the heat transfer from the interior wall of the liquor spray gun to black liquor flowing through the liquor spray gun. This is achieved by providing the interior wall of the liquor spray gun with appropriate heat transfer elements, which increase the area of the interior surface of the tube and thus the contact surface between black liquor and the liquor spray gun. Thus, the interior surface area of the liquor spray gun according to the invention is larger than that of a conventional liquor spray gun having an interior surface devoid of any protrusions or other irregularities facing inwards.

Preferably such heat transfer elements added to the passage of the tube for increasing the area comprise fins rigidly attached to the interior surface of the liquor spray gun tube. By means of modern welding technologies, multiple fins may be formed on the interior surface of the tube. Another preferred method of increasing said contact surface is to arrange grooves on the interior surface of the tube. The direction of the fins or grooves is preferably essentially that of the longitudinal axis of the spray gun tube, but they may as well be arranged in some other way, e.g. helicoidally along the interior surface of the tube. One or more fins or grooves are located parallel to each other with a desired spacing on the interior surface of the tube. Known liquor spray guns are devoid of protrusions or recessions, such as grooves.

The fins in the direction of the longitudinal axis may be continuous pieces extending either to the whole length of the liquor spray gun tube or to a desired portion thereof. Preferably the fins extend substantially continuously to the whole length of the tube. Alternatively, two or more fins significantly shorter than the length of the tube may be arranged consecutively in the direction of the longitudinal axis, resulting in a row of fins. The grooves in the direction of the longitudinal axis of the tube may also be continuous, or two or more shorter grooves are arranged consecutively, resulting in a row of grooves. Usually there are several fin or groove row formations covering a desired part of the interior surface of the tube. The short fins and/or grooves may cover a desired part of the interior surface of the tube consecutively also in other formations than in rows.

The helicoidal fins or grooves may as well be continuous or two or more short fins or grooves may be arranged consecutively. Also, both fins and grooves may be arranged in the spray gun tube in combination. In connection with the invention the word "fin" is used to refer to all kinds of protrusions rigidly attached on the interior surface of the tube and facing the passage of the tube, by means of which the objects of the invention are achieved. Preferably the fins and/or grooves are arranged substantially to the whole length of the tube and not only to a short part of the interior surface thereof.

In the arrangement according to the invention the surface life of the liquor spray gun increases, as heat transfer from the metal wall of the liquor spray gun to black liquor flowing through the spray gun tube is improved. The improvement of the heat transfer results not only from the increase of the heat transfer surface but also from greater turbulence in the black liquor flow caused by the fins or grooves. Due to improved heat transfer, the liquor spray gun is not subjected to such a great heat load, and neither are the conditions as corrosive, due to lower temperature of the spray gun, as in prior art tube solutions having an essentially plane interior surface.

BRIEF DESCRIPTION OF THE DRAWINGS

The present invention is described in more detail with reference to the accompanying figures, of which

DETAILED DESCRIPTION OF THE DRAWINGS

Figure 1:
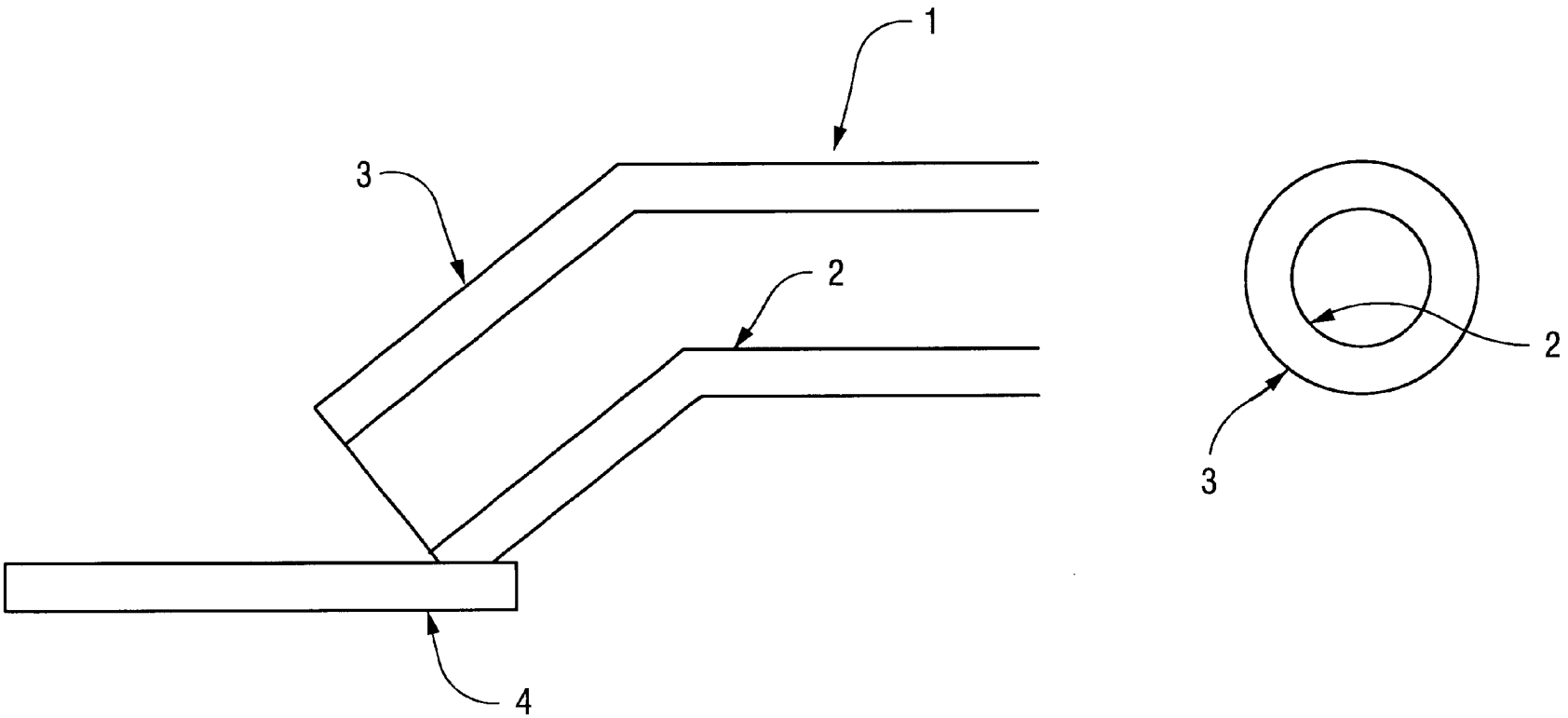
FIG. 1 illustrates a known black liquor spray gun both in partial longitudinal section and cross section.

FIG. 1 illustrates a liquor spray gun 1 known per se. It comprises a tube portion having an interior surface 2 and exterior surface 3. A distributor plate or lip 4 is adapted in the end of the spray gun tube, the form and position of which plate effect the shape of the black liquor jet flowing out of the liquor spray gun. The interior surface 2 of this prior art spray gun construction is plane, devoid of protrusions or recessions, such as grooves.

Figure 2:
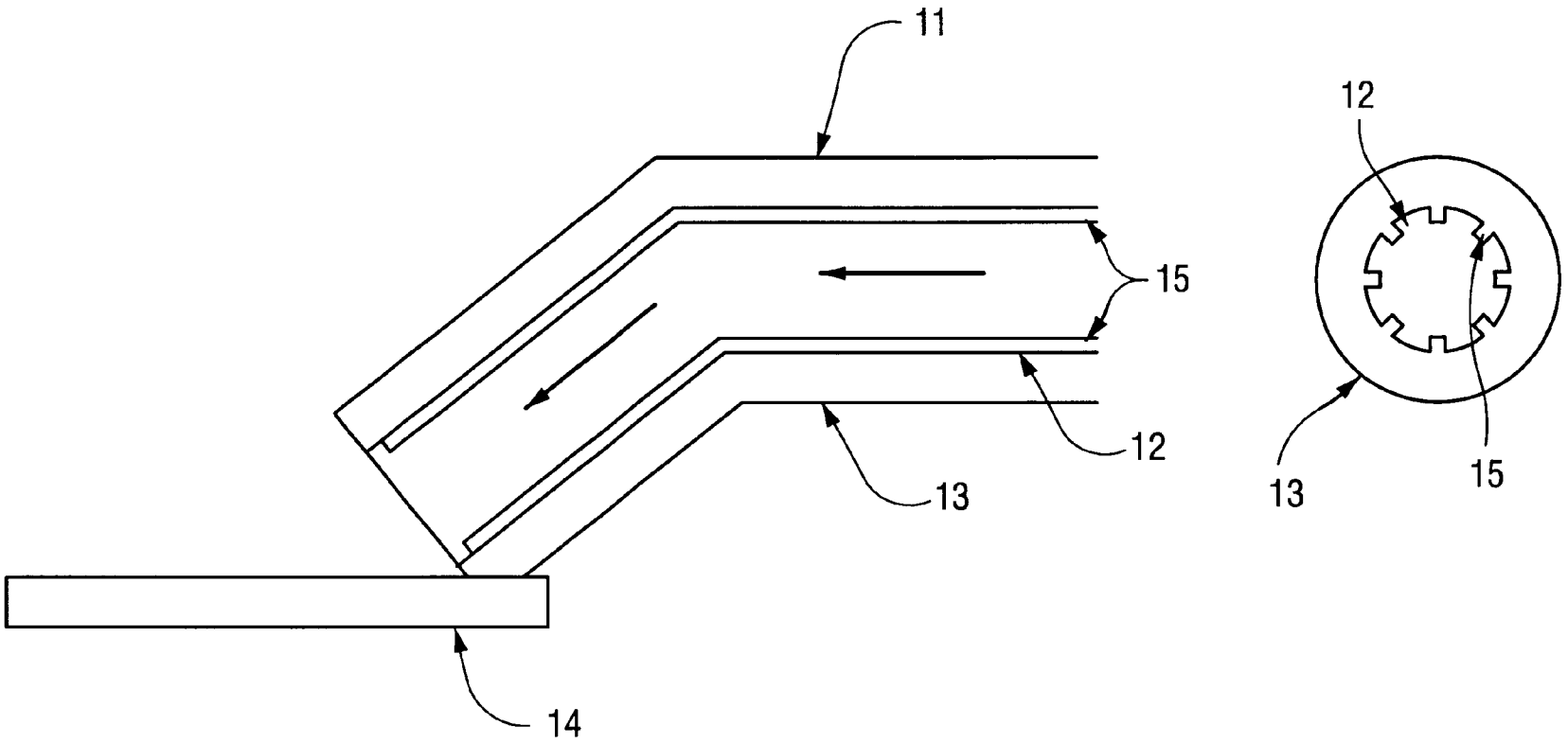
FIG. 2 illustrates a preferred arrangement according to the invention both in partial longitudinal section and cross section.

FIG. 2 illustrates a liquor spray gun 11 according to the present invention. Fins 15, arranged in the direction of the longitudinal axis, are attached by e.g. welding on the interior surface 12 of the liquor spray gun tube. Because of the fins, the contact surface between the black liquor flowing in the tube (the flow direction is shown by arrows) and the interior surface of the tube is increased and heat conductivity from the tube to the liquor is increased over and above the conductivity achieved with a conventional tube passage, such as in the prior art liquor spray gun construction of FIG. 1. Additionally, because of the fins, the interior surface of tube 12 is non-planar, which increases the turbulence of the black liquor flow and thus enhances the heat transfer.

Figure 3:
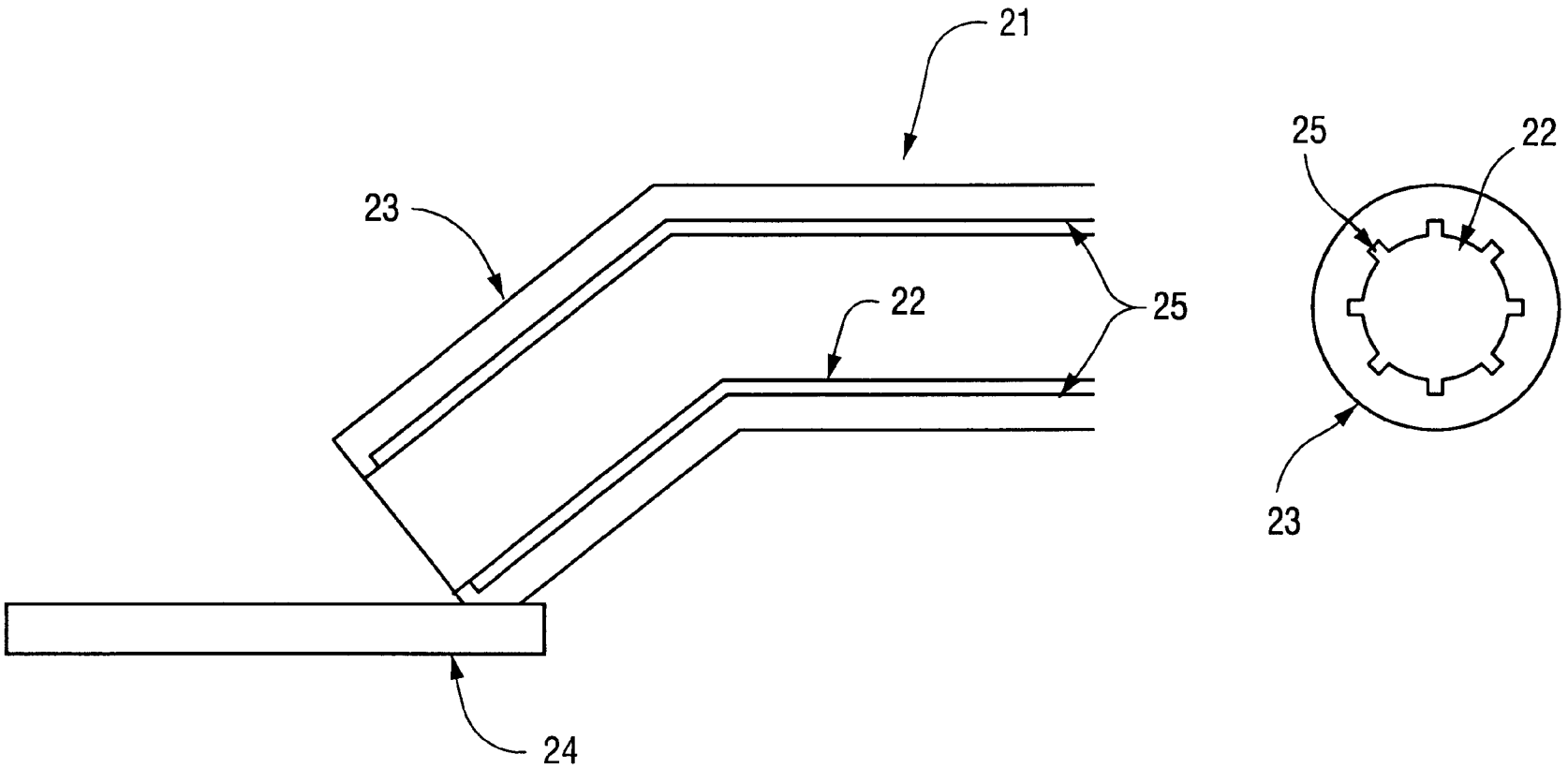
FIG. 3 illustrates another preferred arrangement according to the invention both in partial longitudinal section and cross section.

FIG. 3 illustrates a liquor spray gun 21 according to another embodiment of the present invention, wherein the interior surface of the spray gun tube is provided with grooves 25 in the direction of the longitudinal axis of the tube. These grooves provide for the same kind of effect as the above-described fins for intensifying the heat transfer.

Figure 4:
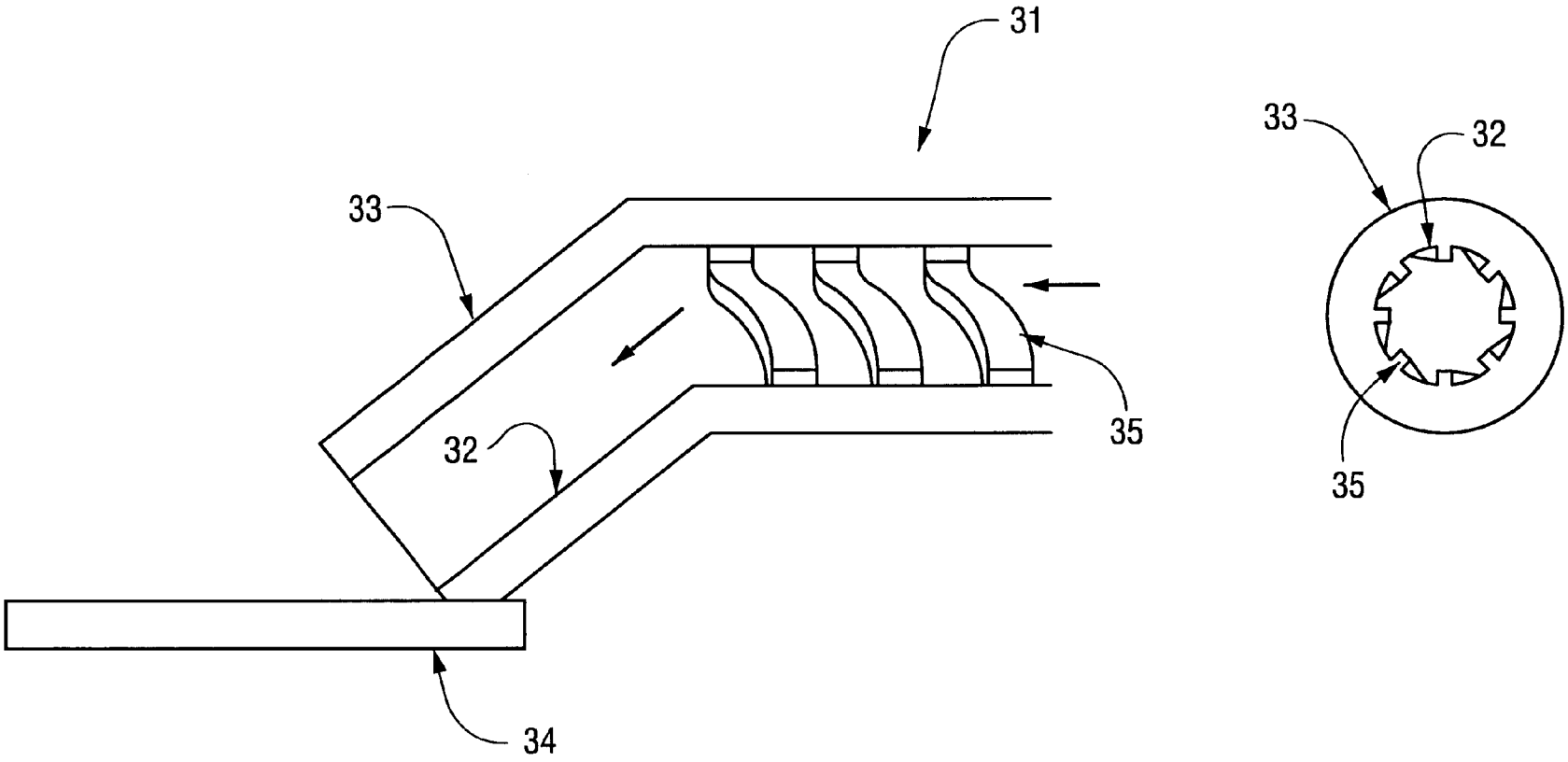
FIG. 4 illustrates a third preferred arrangement according to the invention both in partial longitudinal section and cross section.

In the embodiment of FIG. 4, the fins are arranged approximately transversely in relation to the black liquor flow (shown by arrows). Thereby the interior surface of the tube is provided with a fin 35 passing helicoidally along the interior surface 32. In this case the turbulence is further increased, compared with the constructions of FIGS. 2 and 3.

Alternatively, a helicoidal groove may be machined on the interior surface of the tube to improve heat transfer between the tube and black liquor.

The foregoing detailed description has been given for clarity only, and no unnecessary limitations should be understood therefrom, as modifications will be obvious to those skilled in the art. For example, while the present invention has been described in the foregoing in connection with plate-type spray nozzles, it is apparent that other types of nozzles may be used as well.

What is claimed is:

1. An arrangement for introducing black liquid into a furnace of a recovery boiler, said arrangement comprising an elongated tube having an interior surface and an exterior surface, through which tube the black liquor being fed into the furnace is supplied, wherein the interior surface of the elongated tube is provided with heat transfer elements and surfaces for cooling the tube, and whereby the black liquor is made to contact with said interior surface prior to spraying it into the furnace.

2. Arrangement according to claim 1, wherein the interior surface of the tube is provided with fins.

3. Arrangement according to claim 2, wherein the interior surface of the tube is provided with fins arranged in a direction of a longitudinal axis of the tube.

4. Arrangement according to claim 2, wherein two or more fins are arranged consecutively in a direction of a longitudinal axis of the tube.

5. Arrangement according to claim 2, wherein the interior surface of the tube is provided with at least one fin passing helicoidally along the interior surface.

6. Arrangement according to claim 1, wherein the interior surface of the tube is provided with grooves.

7. Arrangement according to claim 6, wherein the interior surface of the tube is provided with grooves arranged in a direction of a longitudinal axis of the tube.

8. Arrangement according to claim 6, wherein two or more grooves are arranged consecutively in a direction of a longitudinal axis of the tube.

9. Arrangement according to claim 6, wherein the interior surface of the tube is provided with at least one groove passing helicoidally along the interior surface.

10. Arrangement according to claim 1, wherein one or more fins are arranged substantially to a whole length of the tube.

11. Arrangement according to claim 1, wherein one or more grooves are arranged substantially to a whole length of the tube.

12. A method for introducing black liquor into a furnace of a recovery boiler comprising the steps of:

(a) passing the black liquor through an inlet passage to the boiler;

(b) cooling the inlet passage by transferring heat between the inlet and the black liquor, wherein a rate of the heat transfer is increased by heat transfer surfaces of the passage in contact with the black liquor and the rate is greater than a rate of heat transfer achieved in an inlet passage without heat transfer surfaces, and (c) injecting the black liquor into the boiler.

13. A method as in claim 12 wherein said heat transfer surfaces are grooves formed in an interior surface of the inlet passage.

14. A method as in claim 13 wherein said grooves are parallel to a longitudinal axis of said passage.

15. A method as in claim 13 wherein said grooves spiral along a length of said inlet passage.

16. A method as in claim 12 wherein said heat transfer surfaces are fins projecting into a flow of black liquor passing through the inlet.

17. A method as in claim 16 wherein said fins are parallel to a longitudinal axis of said passage.

18. A method as in claim 16 wherein fins spiral along a length of said inlet passage.

19. A method as in claim 12 wherein said inlet passage is an inlet passage in a liquor spray gun.

20. A method as in claim 12 further comprising the step (d) of forming turbulence in the black liquor flowing through the inlet passage.

21. A method as in claim 20 wherein said heat transfer surfaces of the passage form said turbulence.

* * * * *